US008277230B2

(12) United States Patent
Huo et al.

(10) Patent No.: US 8,277,230 B2
(45) Date of Patent: Oct. 2, 2012

(54) ELECTRICAL CONNECTOR AND CONDUCTIVE MEMBER THEREOF

(75) Inventors: Zhu Dong Huo, Keelung (TW); Jian Min Peng, Keelung (TW)

(73) Assignee: Lotes Co., Ltd., Keelung (TW)

( * ) Notice: Subject to any disclaimer, the term of this patent is extended or adjusted under 35 U.S.C. 154(b) by 121 days.

(21) Appl. No.: 12/953,009

(22) Filed: Nov. 23, 2010

(65) Prior Publication Data

US 2011/0318966 A1 Dec. 29, 2011

(30) Foreign Application Priority Data

Jun. 24, 2010 (CN) ..... 2010 2 0242360 U

(51) Int. Cl.
*H01R 12/00* (2006.01)

(52) U.S. Cl. ..... 439/66; 439/342; 439/784

(58) Field of Classification Search ..... 439/66, 439/342, 784

See application file for complete search history.

(56) References Cited

U.S. PATENT DOCUMENTS

| | | | | |
|---|---|---|---|---|
| 6,679,709 | B2 * | 1/2004 | Takeuchi | 439/83 |
| 7,125,293 | B2 * | 10/2006 | Mongold et al. | 439/874 |
| 7,896,680 | B2 * | 3/2011 | Szu | 439/342 |
| 7,922,548 | B2 * | 4/2011 | Fan | 439/862 |
| 7,993,145 | B1 * | 8/2011 | Howell et al. | 439/71 |
| 8,052,454 | B2 * | 11/2011 | Polnyi | 439/342 |

* cited by examiner

*Primary Examiner* — Truc Nguyen

(74) *Attorney, Agent, or Firm* — Morris Manning & Martin LLP; Tim Tingkang Xia, Esq.

(57) ABSTRACT

An electrical connector and a conductive member thereof are provided. In one embodiment of the present invention, the conductive member is installed in an insulating body, and a solder ball is retained between two retaining ends of the conductive member to form the electrical connector. In the conductive member, a base extends downwards to form two soldering arms, each of the soldering arms has an extending arm and a retaining end extending from the extending arm, the retaining ends are exposed outside the insulating body, and at least one of the retaining ends is provided with a recessed portion, so as to enable the solder ball, when entering between the two retaining ends, to prop the two retaining ends and partially enter the recessed portion, so that the solder ball is securely retained by the two retaining ends, thereby preventing the solder ball from falling off from the two retaining ends when the electrical connector is under an external force.

15 Claims, 8 Drawing Sheets

ELECTRICAL CONNECTOR AND CONDUCTIVE MEMBER THEREOF

CROSS-REFERENCE TO RELATED PATENT APPLICATION

This non-provisional application claims benefits and priority under 35 U.S.C. §119(a) on Chinese Patent Application No. 20102024230.X filed in The People's Republic of China on Jun. 24, 2010, which is incorporated herein by reference in its entirety.

Some references, if any, which may include patents, patent applications and various publications, are cited in a reference list and discussed in the description of this invention. The citation and/or discussion of such references is provided merely to clarify the description of the present invention and is not an admission that any such reference is "prior art" to the invention described herein. All references, if any, listed, cited and/or discussed in this specification are incorporated herein by reference in their entireties and to the same extent as if each reference was individually incorporated by reference.

BACKGROUND OF THE PRESENT INVENTION

1. Field of the Invention

The present invention relates to an electrical connector and a conductive member thereof, and more particularly to a conductive member of an electrical connector that is capable of securely retaining a solder ball and achieving desirable soldering.

2. Description of the Related Art

In a conventional electrical connector, a single-arm conductive member is used, and a solder ball must be firstly soldered on a tail portion of the conductive member and then soldered on a circuit board. As a result, the cost of the soldering process is increased and an insulating body of the electrical connector may be easily deformed under heat.

To solve the above problems, a double-arm conductive member has been proposed in the field. Several double-arm conductive members are installed in corresponding through holes of an insulating body to form an electrical connector. The conductive member has a base fixed in the through hole, two retaining arms extending in parallel downwards from the base are exposed outside the insulating body, and a gap is formed between the two retaining arms to retain a solder ball therein. The retaining arms do not extend outwards beyond extension lines of side surfaces of the base.

Although the above structure adopts two retaining arms to retain the solder ball so as to save the pre-soldering process, the following defects still exist. Nowadays, with the rapid development of science and technology, the electrical connector develops towards light, small and thin structure, i.e., more functions are realized by increasing the number of conductive members without changing the original size of the insulating body. The number of through holes of the insulating body is also increased in accordance with the number of conductive members, which means that the space inside the through holes becomes smaller, so the retaining arms of the conductive member are exposed outside the through hole to retain the solder ball so as to effectively utilize the space. However, since the two retaining arms extend in parallel downwards from the base, and the retaining arms do not extend outwards beyond the extension lines of the side surfaces of the base, the space between the two retaining arms is limited. Moreover, the retaining arms do not provide any structure for holding the solder ball, so that the solder ball easily slides between the two retaining arms and is easily released from retention of the two retaining arms when the electrical connector is under an external force.

Therefore, a heretofore unaddressed need exists in the art to address the aforementioned deficiencies and inadequacies.

SUMMARY OF THE PRESENT INVENTION

In one aspect, the present invention provides a conductive member capable of securely retaining a solder ball and achieving desirable soldering and an electrical connector using the same.

Among other things, the present invention adopts the following inventive measures and provides an electrical connector in one embodiment that includes: an insulating body, having a plurality of receiving holes; a plurality of conductive members, respectively received in one of the receiving holes correspondingly and each having a base fixed to the receiving hole, an elastic arm bent and extending from an upper end of the base, and two soldering arms extending from a lower end of the base, in which a gap is formed between the two soldering arms, each of the soldering arms has an extending arm and a retaining end extending from the extending arm, the retaining ends are exposed outside the receiving hole, at least one of the retaining ends is provided with a recessed portion facing the gap, and the recessed portion is in communication with the gap; and a plurality of solder balls, respectively entering the gap between the corresponding two retaining ends, partially entering the recessed portion, and propping the two retaining ends.

In another aspect, the present invention provides a conductive member that includes: a base; an elastic arm, bent and extending from an upper end of the base; and two soldering arms, extending from a lower end of the base, in which a gap is formed between the two soldering arms, each of the soldering arms has an extending arm and a retaining end extending from the extending arm, at least one of the retaining ends is provided with a recessed portion facing the gap, and the recessed portion is in communication with the gap.

As compared with the prior art, among other things, the electrical connector and conductive member thereof of the present invention are configured such that the base extends downwards to form two soldering arms, each of the soldering arms has an extending arm and a retaining end extending from the extending arm, the retaining ends are exposed outside the receiving hole, and at least one of the retaining ends is provided with a recessed portion, so as to enable the solder ball, when entering between the two retaining ends, to prop the two retaining ends and partially enter the recessed portion, so that the solder ball is securely retained by the two retaining ends, thereby preventing the solder ball from falling off from the two retaining ends when the electrical connector is under an external force.

These and other aspects of the present invention will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The drawings described below are for illustration purposes only. The drawings are not intended to limit the scope of the present teachings in any way.

DETAILED DESCRIPTION OF THE PRESENT INVENTION

Figure 1:
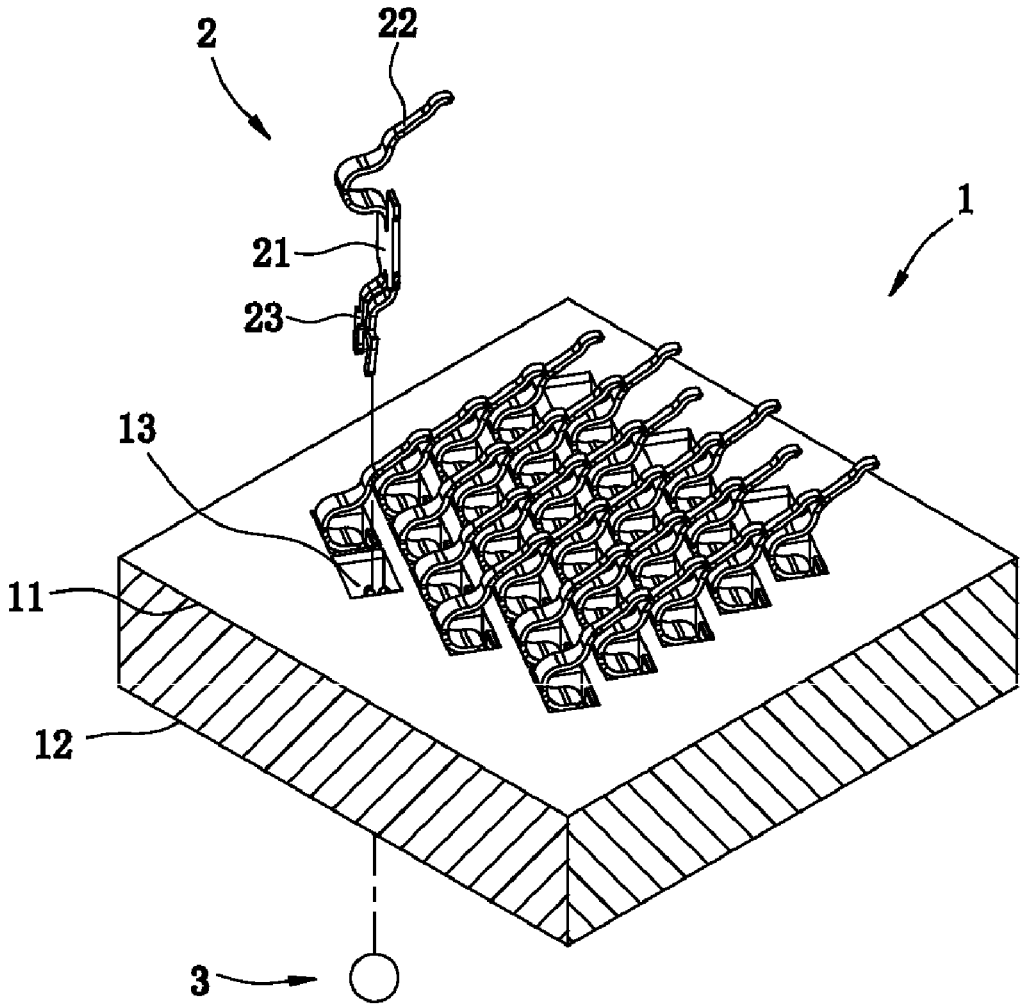
FIG. 1 is an exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, FIGS. 1-5, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention. Additionally, some terms used in this specification are more specifically defined below.

DEFINITIONS

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

A list of reference numerals with corresponding components as shown in the drawings is given below only for the purpose of a reader's convenience:

Insulating body 1
Top surface 11
Bottom surface 12
Receiving hole 13
Beam 131
Protruding block 14
Reserved space 141
Stop block 15
Conductive member 2
Base 21
First fixing portion 211
Elastic arm 22
Soldering arm 23
Extending arm 231
Bending portion 2311
Retaining end 232
Hook portion 233
Material connection part 24
Second fixing portion 241
Connecting portion 25
Solder ball 3
Gap 4
Recessed portion 5
Inner wall surface 51
Clearance 6.

Referring now to FIGS. 1 to 9, the electrical connector and conductive member thereof of the present invention are further described in detail below with reference to the accompanying drawings and specific embodiments.

Referring first to FIGS. 1 to 6, an electrical connector according to a first embodiment of the present invention includes an insulating body 1, a plurality of conductive members 2, and a plurality of solder balls 3.

Figure 2:
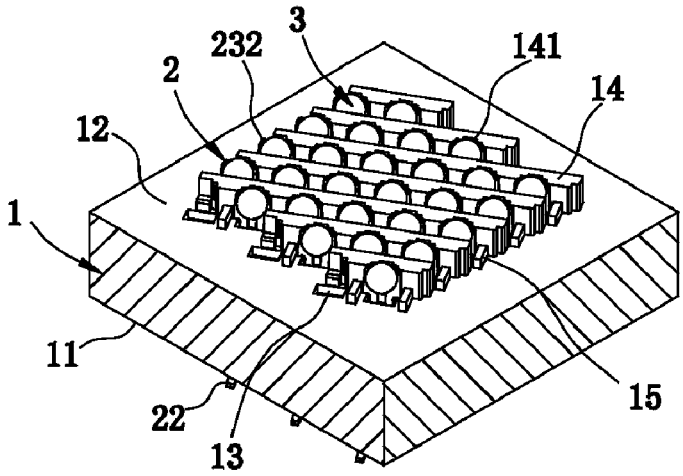
FIG. 2 illustrates the electrical connector according to the first embodiment of the present invention from another angle of view.

Referring to FIGS. 1 and 2, the insulating body 1 has a top surface 11 and a bottom surface 12 opposite to each other, and a plurality of receiving holes 13 formed through the top surface 11 and the bottom surface 12.

The bottom surface 12 is provided with a plurality of protruding blocks 14 and a plurality of stop blocks 15, in which every two protruding blocks 14 and adjacent two stop blocks 15 are located on a periphery of the same receiving hole 13, the two protruding blocks 14 are located on two opposite sides of the receiving hole 13, and the two stop blocks 15 are located on two opposite sides of the receiving hole 13.

The protruding blocks 14 on the peripheries of the receiving holes 13 in the same row are connected together. One of the two protruding blocks 14 on the periphery of the receiving hole 13 is recessed with a reserved space 141 which has an opening end facing the receiving holes 13.

In the vertical direction, the stop blocks 15 are lower than the protruding blocks 14. The stop blocks 15 are perpendicular to the adjacent protruding blocks 14, and are connected to the adjacent two protruding blocks 14 so as to enclose the adjacent receiving hole 13. Definitely, in other embodiments, the protruding blocks 14 in the same row may not be connected together, and the stop blocks 15 may not be connected to the adjacent two protruding blocks 14.

Two opposite side walls of the receiving hole 13 are respectively recessed with a fixing slot (not shown) facing the receiving hole 13.

Figure 3:
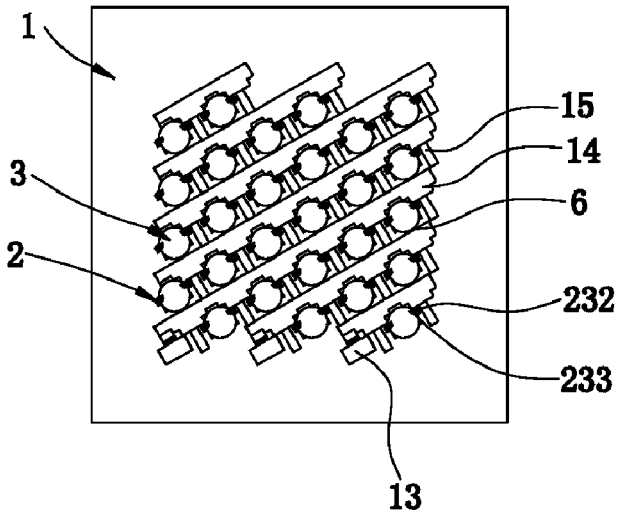
FIG. 3 is a front view of the electrical connector in FIG. 2.

Referring to FIGS. 1 to 3, the conductive member 2 is installed in the corresponding receiving hole 13. The conductive member 2 includes a base 21, an elastic arm 22 bent and extending backwards from the base 21 and then forwards, and two soldering arms 23 extending downwards from the base 21. The elastic arm 22 is exposed outside the top surface 11. The soldering arms 23 are exposed outside the bottom surface 12, the soldering arms 23 are parallel to the adjacent protruding blocks 14, and the soldering arms 23 are perpendicular to the adjacent stop blocks 15.

Figure 4:
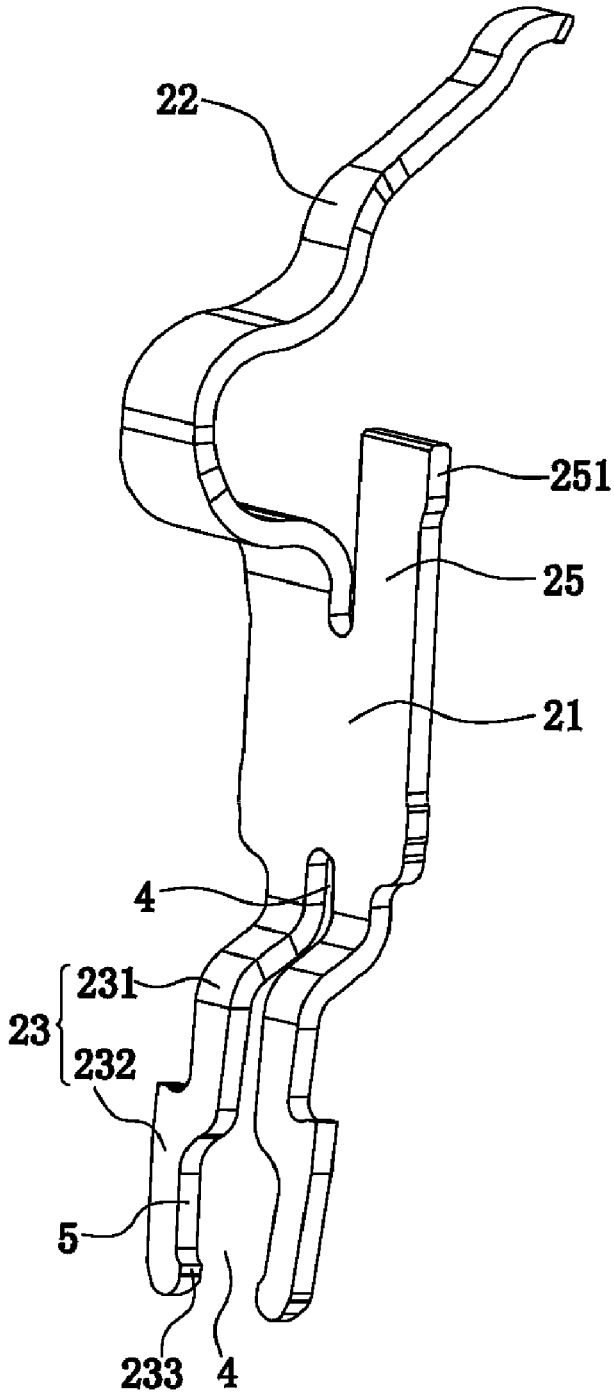
FIG. 4 is a three-dimensional view of a conductive member according to the first embodiment of the present invention.
Figure 5:
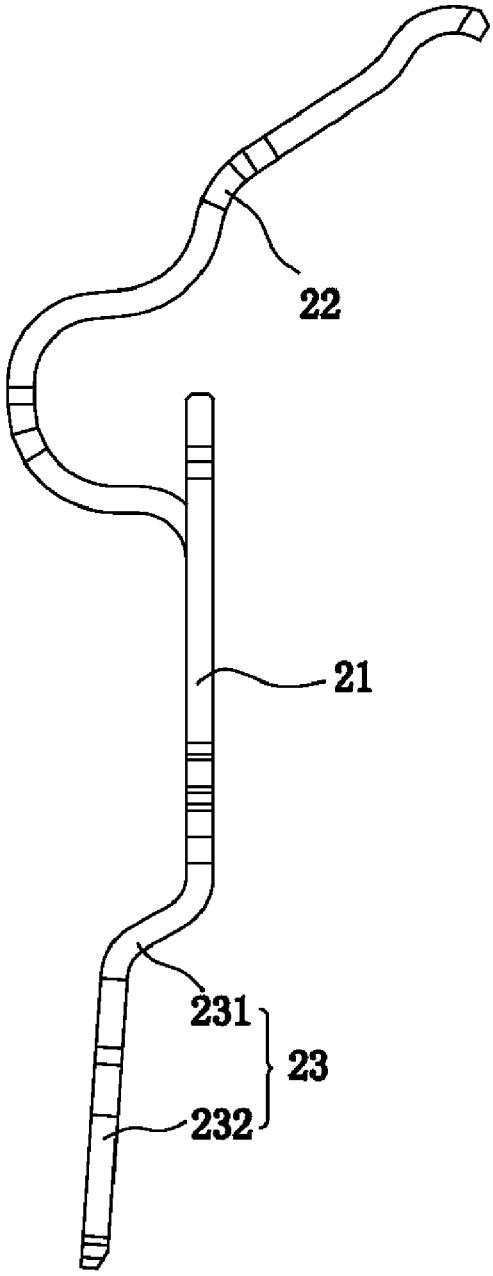
FIG. 5 is a side view of the conductive member in FIG. 4.
Figure 6:
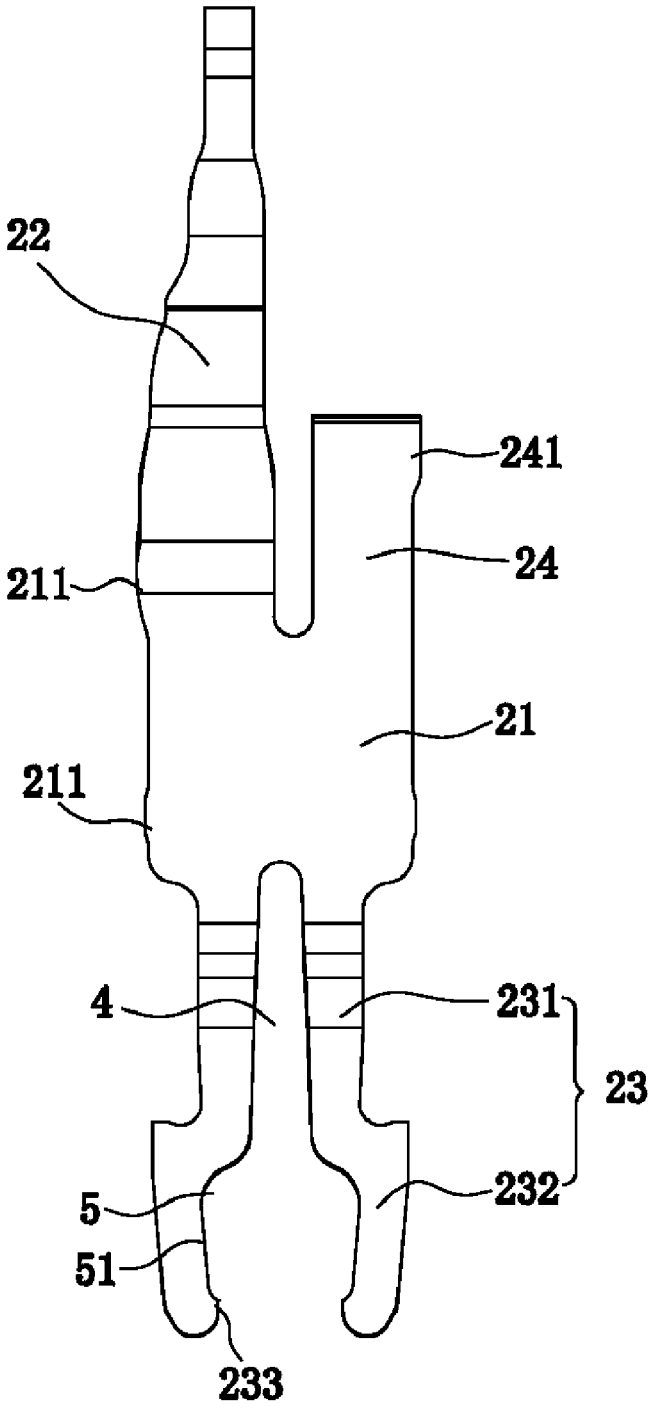
FIG. 6 is a front view of the conductive member in FIG. 4.

Referring to FIGS. 4 and 6, the base 21 is provided with a first fixing portion 211 on one side thereof, and the first fixing portion 211 enters a corresponding fixing slot (not shown) in the receiving hole 13 and is thus positioned.

The base 21 is bent backwards and then forwards to form the elastic arm 22 and extends upwards vertically to form a material connection part 24, and the elastic arm 22 is not connected to the material connection part 24. The elastic arm 22 and the first fixing portion 211 are located on the same side of the base 21. The material connection part 24 is provided with a second fixing portion 241 on one side thereof.

The base 21 extends downwards to form two soldering arms 23, and a gap 4 is formed between the two soldering arms 23. Each of the soldering arms 23 has a bending extending arm 231 and a retaining end 232 extending from the extending arm 231, and the retaining end 232 has a width smaller than that of the extending arm 231. The retaining end 232 is deviated outwards from the extending arm 231, and a recessed portion 5 is formed at the deviated position, the recessed portion 5 is in communication with the gap 4, and the retaining end 232 is partially located beyond an extension plane of a wall of the receiving hole 13 (as shown in FIGS. 2 and 3). An inner wall surface 51 of the recessed portion 5 is an arc-shaped surface matching the solder balls 3. Tail ends of the two retaining ends 232 are bent towards each other to form a hook portion 233 respectively.

Referring to FIGS. 2 and 3, the solder ball 3 is spaced by a clearance 6 from the protruding blocks 14 and the stop blocks 15 on the periphery of the receiving hole 13, so as to provide a space for the solder ball 3 to expand when melted. The solder ball 3 is installed between the two retaining ends 232 of the corresponding conductive member 2, and partially enters the recessed portion 5, so that the two retaining ends 232 of the conductive member 2 retain the widest part (i.e., the diameter) of the solder ball 3, and meanwhile, the solder ball 3 props the two retaining ends 232, so that the solder ball 3 is securely retained by the two retaining ends 232, thereby preventing the solder ball 3 from falling off from the two retaining ends 232 when the electrical connector is under an external force. When the solder ball 3 is melted, the hook portions 233 break the surface tension of the solder ball 3 and penetrate into the solder ball 3.

Referring to FIGS. 1 and 3, during assembly, the conductive member 2 is correspondingly installed into the receiving hole 13 from the top surface 11 to the bottom surface 12, the first fixing portion 211 and the second fixing portion 241 respectively enter the corresponding fixing slots (not shown), the elastic arm 22 is exposed outside the top surface 11, the two retaining ends 232 are exposed outside the bottom surface 12 and are located on one side of the reserved space 141 and between the two stop blocks 15, and the two retaining ends 232 are parallel to the adjacent protruding blocks 14 and are perpendicular to the adjacent stop blocks 15.

Then, the solder ball 3 is riveted between the two retaining ends 232 of the corresponding conductive member 2 from the bottom surface 12. Thus, the assembly of the electrical connector is completed.

Figure 7:
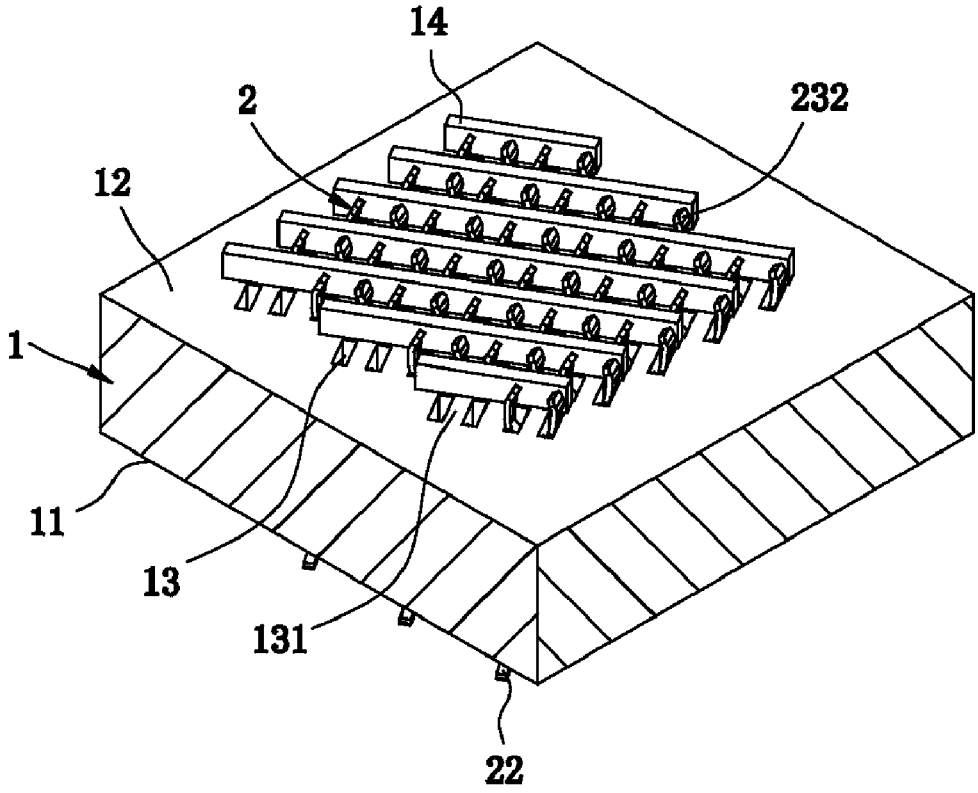
FIG. 7 is a three-dimensional view of an electrical connector with no solder ball installed therein according to a second embodiment of the present invention.
Figure 8:
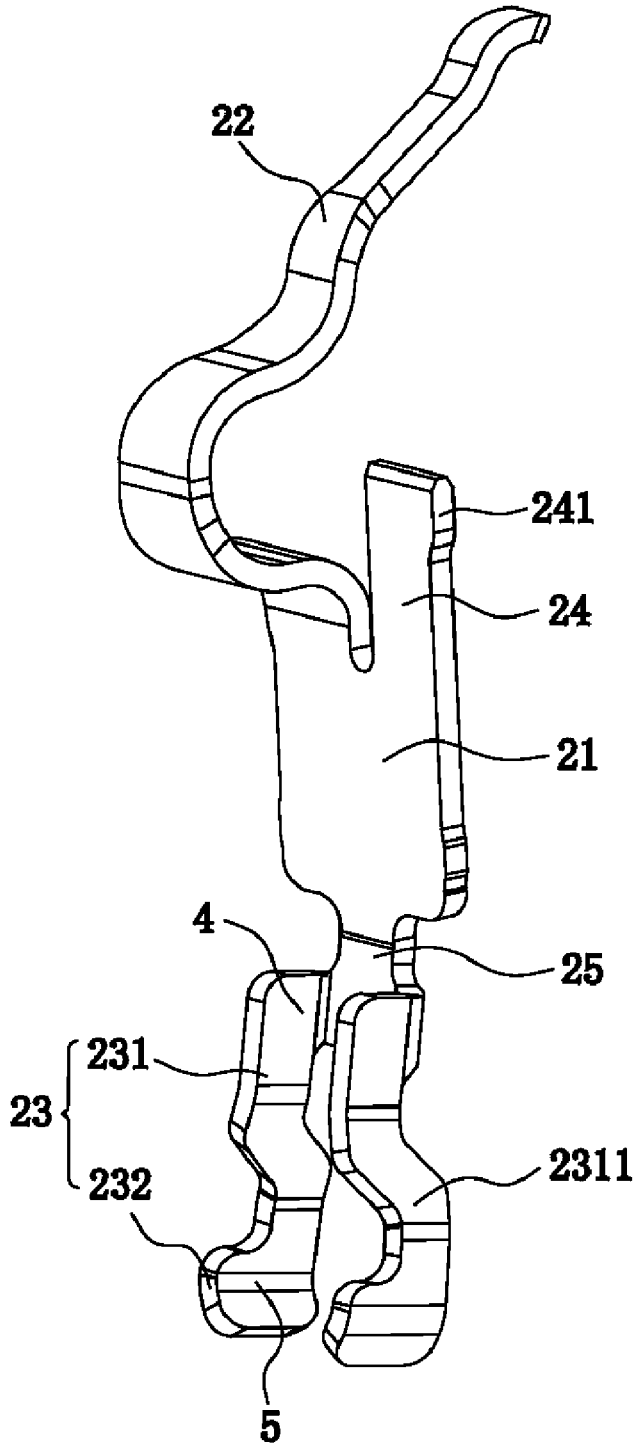
FIG. 8 is a three-dimensional view of a conductive member according to the second embodiment of the present invention.
Figure 9:
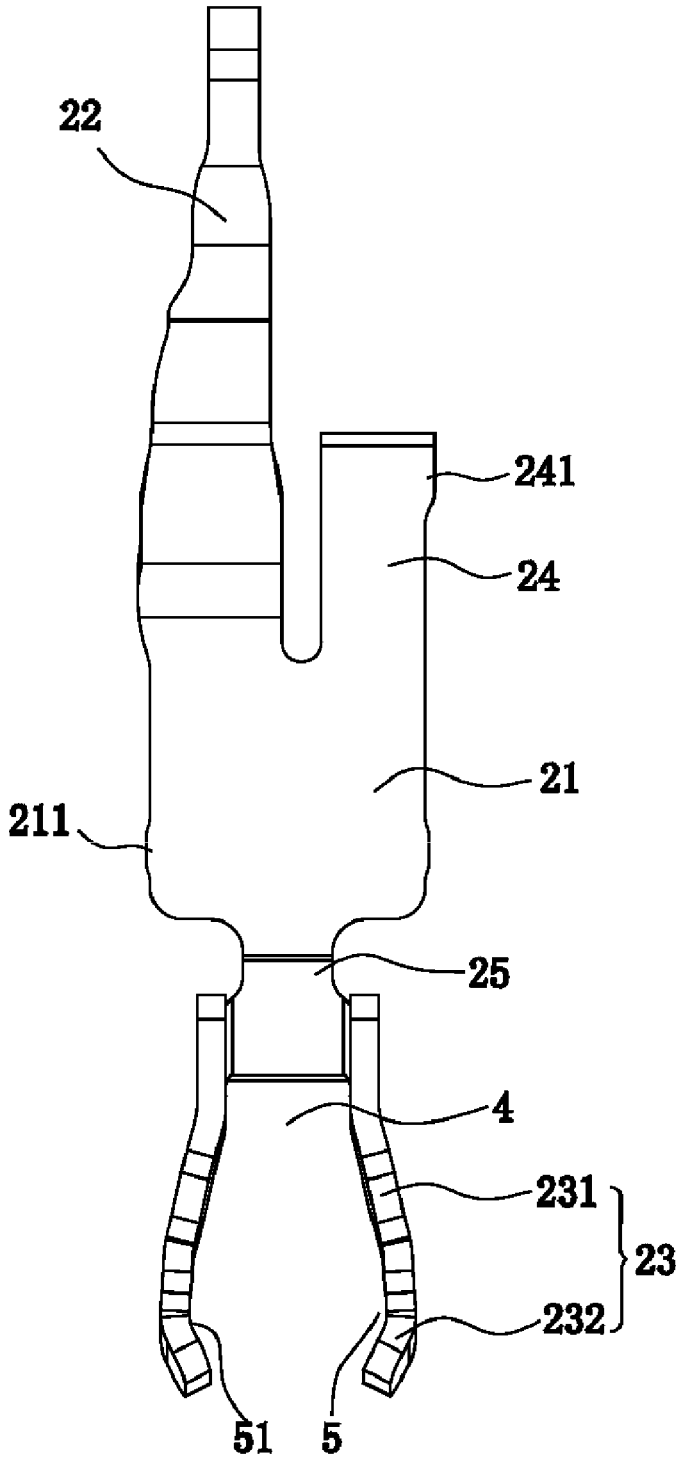
FIG. 9 is a front view of the conductive member in FIG. 8.

Referring to FIGS. 7 and 9, a second embodiment of the present invention is shown, and the difference between the second embodiment and the first embodiment lies in that the bottom surface 12 is not provided with the stop blocks 15 and the protruding block 14 is not provided with the reserved space 141. A beam 131 extends across the middle part of the receiving hole 13, and the two retaining ends 232 are respectively located on two sides of the beam 131.

The two soldering arms 23 are connected to the base 21 through a connecting portion 25, and the two soldering arms 23 are bent backwards from two sides of the connecting portion 25 and then bent downwards. The extending arm 231 is provided with a bending portion 2311 bent forwards, thereby extending the length of the extending arm 231 and increasing the elasticity thereof. The retaining end 232 directly extends downwards from the bending portion 2311, the two retaining ends 232 are bent towards each other, and the recessed portion 5 is formed at the bending position. The retaining end 232 has a width greater than that of the extending arm 231, so as to increase the area for retaining the solder ball 3. When the solder ball 3 is melted, the tail ends of the retaining ends 232 break the surface tension of the solder ball 3 and penetrate into the solder ball 3. This embodiment can achieve the same effect as that of the first embodiment, so that the details will not be described herein again.

Accordingly, among other things, the electrical connector and conductive member thereof according to various embodiments of the present invention have the following advantages.

1. When the solder ball enters between the two retaining ends, since the retaining end of the conductive members is provided with the recessed portion facing the solder ball, and the solder ball partially enters the recessed portion, the solder ball is securely retained between the two retaining ends, thereby preventing the solder ball from being released from retention of the two retaining arms when the electrical connector is under an external force.

2. Since the width of the retaining end is greater than that of the extending arm, the area for retaining the solder ball is increased, thereby ensuring desirable retention of the solder ball.

3. Since the width of the retaining end is smaller than that of the extending arm, after the solder ball is inserted, the elasticity of the soldering arms is increased, so that the retaining ends retain the solder ball more tightly.

4. Since the two opposite protruding blocks are provided on the periphery of the receiving hole, and the conductive member is provided with the two retaining ends, the position of the solder ball is restricted in the transverse and longitudinal directions, thereby ensuring that the solder ball is retained at a predetermined position between the two retaining ends.

5. Since the two opposite stop blocks are provided on the periphery of the receiving hole, and the stop blocks are perpendicular to the retaining ends of the conductive member in the receiving hole, the stop blocks can urge against the retaining ends when the solder ball enters between the two retaining ends and props the two retaining ends such that the retaining ends undergo elastic deformation, thereby preventing the retaining ends from being excessively bent or broken without the support of the stop blocks.

6. Since the solder ball is spaced by the clearance from the adjacent protruding blocks and stop blocks, a space is provided for the solder ball to expand when melted.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having a plurality of receiving holes, wherein the insulating body has a top surface and a bottom surface opposite to each other;

a plurality of conductive members, respectively received in one of the receiving holes correspondingly and each having a base fixed to the receiving hole, an elastic arm bent and extending from an upper end of the base, and two soldering arms extending from a lower end of the base, wherein a gap is formed between the two soldering arms, each of the soldering arms has an extending arm and a retaining end extending from the extending arm, the retaining ends are exposed outside the receiving hole, at least one of the retaining ends is provided with a recessed portion facing the gap, and the recessed portion is in communication with the gap, wherein the bottom surface of the insulating body is provided with a plurality of protruding blocks, every two protruding blocks are located on two opposite sides on a periphery of the receiving hole, and the protruding blocks are parallel to the adjacent two retaining ends; and a plurality of solder balls, respectively entering the gap between the corresponding two retaining ends, partially entering the recessed portion, and propping the two retaining ends, wherein a position of each solder ball is restricted in a transverse direction by the corresponding two retaining ends and restricted in a longitudinal direction by the corresponding two protruding blocks.

2. The electrical connector according to claim 1, wherein an inner wall surface of the recessed portion is configured to match a shape of the solder balls.

3. The electrical connector according to claim 1, wherein the retaining end is deviated outwards from the extending arm, and the recessed portion is formed at the deviated position.

4. The electrical connector according to claim 1, wherein the two retaining ends are bent towards each other, and the recessed portion is formed at the bending position.

5. The electrical connector according to claim 1, wherein the two soldering arms are connected to the base through a connecting portion, and the two soldering arms are bent backwards from two sides of the connecting portion and then bent downwards.

6. The electrical connector according to claim 1, wherein the retaining end has a width greater than that of the extending arm.

7. The electrical connector according to claim 1, wherein the retaining end has a width smaller than that of the extending arm.

8. The electrical connector according to claim 1, wherein a tail end of the retaining end is provided with a hook portion facing the gap.

9. The electrical connector according to claim 1, wherein each of the retaining ends is provided with the recessed portion, and the two retaining ends of the conductive member at least retain a widest part of the solder ball.

10. The electrical connector according to claim 1, wherein the retaining end is partially located beyond an extension plane of a wall of the receiving hole.

11. The electrical connector according to claim 1, wherein the solder balls are spaced from the adjacent protruding blocks.

12. The electrical connector according to claim 1, wherein the protruding blocks on the peripheries of the receiving holes in the same row are connected together.

13. The electrical connector according to claim 1, wherein one of the protruding blocks on the periphery of the receiving hole is recessed with a reserved space facing the receiving hole.

14. The electrical connector according to claim 1, wherein the bottom surface is provided with a plurality of stop blocks, every two stop blocks are located on two opposite sides on a periphery of the receiving hole, and the stop blocks are perpendicular to the adjacent two retaining ends.

15. The electrical connector according to claim 1, wherein a beam extends across the receiving hole, and the two retaining ends are respectively located on two sides of the beam.

* * * * *